US005613527A

United States Patent [19]

Zimmermann et al.

[11] Patent Number: 5,613,527

[45] Date of Patent: Mar. 25, 1997

[54] FORMING SCREEN HAVING FLATTENED CROSS THREADS

[75] Inventors: Daniel Zimmermann, Mulhouse, France; Liam Maher, Tralee, Ireland

[73] Assignee: Siebtuchfabrik AG, Switzerland

[21] Appl. No.: 382,046

[22] PCT Filed: Aug. 20, 1993

[86] PCT No.: PCT/EP93/02234

§ 371 Date: Feb. 10, 1995

§ 102(e) Date: Feb. 10, 1995

[87] PCT Pub. No.: WO94/04748

PCT Pub. Date: Mar. 3, 1994

[30] Foreign Application Priority Data

Aug. 25, 1992 [DE] Germany ..... 9211391 U

[51] Int. Cl.[6] ..... D21F 1/00

[52] U.S. Cl. ..... 139/383 A

[58] Field of Search ..... 139/383 A, 425 A, 139/383 AA

[56] References Cited

U.S. PATENT DOCUMENTS

| | | | |
|---|---|---|---|
| 2,003,123 | 5/1935 | Specht | 245/8 |
| 3,139,119 | 6/1964 | Buchanan | 139/425 |
| 3,143,150 | 8/1964 | Buchanan | 139/425 |
| 3,545,705 | 12/1970 | Hodgson | 245/8 |
| 3,632,068 | 1/1972 | Weir | 245/8 |
| 4,142,557 | 3/1979 | Kositzke | 139/425 |
| 4,749,007 | 6/1988 | Malmendier | 139/425 A X |
| 4,815,499 | 3/1989 | Johnson | 139/383 A |
| 4,829,681 | 5/1989 | Josef | 139/383 A X |
| 5,066,532 | 11/1991 | Gaisser | 139/383 A |
| 5,089,324 | 2/1992 | Jackson | 428/234 |
| 5,094,719 | 3/1992 | Fry | 139/383 A |
| 5,151,316 | 9/1992 | Durkin et al. | 139/383 A |

FOREIGN PATENT DOCUMENTS

| | | | |
|---|---|---|---|
| 0269070 | 11/1987 | European Pat. Off. . | |
| 0273892 | 7/1988 | European Pat. Off. | 139/383 A |
| 0390005 | 3/1990 | European Pat. Off. . | |
| 9115480 | 3/1992 | Germany . | |
| 9211776 | 12/1992 | Germany . | |
| 2157328 | 4/1984 | United Kingdom . | |
| WO8805841 | 12/1987 | WIPO . | |

*Primary Examiner*—Andy Falik

*Attorney, Agent, or Firm*—Joseph W. Berenato, III

[57] ABSTRACT

A paper machine forming screen has a paper side and a machine side. A plurality of synthetic longitudinally extending machine direction threads are provided. A plurality of synthetic cross threads extend generally transverse to the machine direction threads, and the cross threads are disposed in first and second groups and at least of the cross threads have a flattened cross section. The first group threads are disposed in a plane of the paper side and have a repeat floating over a number of the machine direction threads. The second group threads form a plane on the machine side. The flattened cross threads extend parallel to the paper side plane, a distance from about 1.2 to about 2.2 times the distance by which the flattened cross threads extend transverse to the paper side plane.

36 Claims, 3 Drawing Sheets

FORMING SCREEN HAVING FLATTENED CROSS THREADS

FIELD OF THE INVENTION

The invention describes a forming screen for the sheet forming zone of a paper machine and consists of a multi-layer, especially flat-woven material made of synthetic material threads with longitudinal threads which run in machine direction and cross threads which run crosswise whereby a first group of cross threads is located in the plane of the paper side and floats across longitudinal threads whose number is at least equal to the number of the cross threads, across which the longitudinal threads float on the paper side and whereby the plane of the machine side is formed exclusively by a second group of cross threads.

DESCRIPTION OF THE PRIOR ART

A customary paper machine in general consists of three successive zones. In the individual zones the sheet is drained or dried in different manner. During the process, the sheet is supported and guided by so-called paper machine coverings.

For this purpose a forming screen is used for this purpose in the first zone, the so-called sheet forming zone. The liquid to pulpy fibrous material is applied to the screen. With the help of gravity, supported by suction boxes which create negative pressure, the fibrous material is drained to a point in which a continuous, if very sensitive, sheet of paper with a high fluid content is generated at the end of the forming screen. The sheet is removed from the forming screen and brought to the second zone, the so-called press section. There the sheet is subjected to high pressure between two rollers so that the water is drained. It is supported by press felts which in general consist of a base fabric and a spun-bonded material which is pinned to it at least on the paper side. In the third zone, the drying zone, the sheet for the most part is drained thermally. It is guided over heated drying cylinders with hardly any pressure. The sheet is supported by so-called skeleton screens whereby the skeleton screens can be made of material or wire link conveyors.

Due to the different types of draining in the different zones of the paper machine, the respective paper machine coverings— forming screen, press felts and skeleton screen— must meet different requirements. This means that in general they all have a very different structure. This applies especially to water permeability, thickness of the material, endurance, etc. Paper machine coverings which are used in one zone in general can never be used in another zone.

The forming screen must meet special requirements. This is due to the fact that the forming screens above all must form a sheet of paper out of a liquid mass and that— contrary to the pressing and drying zone— there is no continuous sheet of paper. This means that when a forming screen is designed, special attention must be given to the behavior of the different fibers with regard to the forming screen. This is a requirement which is not necessary in the pressing and drying zones since there already is a continuous sheet of paper which reaches these zones. Often times the requirements contradict each other, i.e. a compromise must be reached. This means that a forming screen must have good separation capabilities, i.e. on one hand it must retain the paper fibers on the paper-side surface of the forming screen and on the other hand it must drain the material well. This characteristic of retaining the fibers on the forming screen must be combined with the ability to prevent the fibers from being pulled into the forming screen and causing a sheet sealing. The sheet sealing not only means that the material is not draining very well, but that it is harder to remove the sheet at the end of the forming screen since it is interlaced with the screen.

Another requirement which is especially important for forming screens, is a very long service life. Contrary to the paper machine coverings used in the pressing and drying zones, a forming screen is guided over deflection pulleys but also over rigid machine parts which means that it is subjected to high friction forces. Especially when suction boxes are involved which support gravity draining by developing negative pressure, strong bearing pressure acts on the forming screen which runs on the machine parts and high friction occurs. For this reason especially resistant synthetic materials are used on the machine side, and the paper side and machine side structure are decoupled. On the machine side, certain cross threads work as a friction material which then form the plane of the machine side all by themselves. These cross threads protect the longitudinal threads which are highly loaded due to the longitudinal stress in the forming screen against wear by friction and therefore against a weakening of their stability.

This type of paper machine screen is described in patent EP-A-0 390 005, for example. On the machine side it has longitudinally floating cross threads which form the plane of the machine side and therefore protect the longitudinal threads against wear by friction. On the paper side the longitudinal and cross threads are integrated in a way which produces a monoplane surface, if possible. The longitudinal as well as the cross threads have a conventional circular cross section. This has a number of disadvantages.

On the paper side the individual fibers are not supported sufficiently. The material gaps, which open up conically due to the circular cross section, cause a part of the fibers to be pulled into the inside of the screen. This means that it is difficult to remove the paper from the screen since the material and the fibers are interlaced. This in turn means that the sheet of paper is rough on the surface and is difficult to imprint. Another disadvantage is that dynamic pressure variations which occur in the carried along water when the wet part runs over the machine parts, can easily reach the sheet of paper and stain it.

On the machine side a sufficient amount of abrasion can only be achieved if relatively thick cross threads are used. However, these are restricted in their flexibility which means that the longitudinal threads are pushed close to the plane of the machine side when they are integrated with the cross threads and that they are worn out comparatively quickly. The fact that the screening characteristics change considerably and with different speeds when the cross threads, which form the machine side, are worn is even more significant. Due to the long flotation and the stiffness of these cross threads a curve shaped gradient appears between the integration points which means that the contact surface changes constantly and irregularly in longitudinal as well as in cross direction when abrasion occurs.

There have been many proposals which suggest using flattened longitudinal threads for the forming screens. These proposals were initially were intended for single-layer forming screens only and of those primarily for metal screens (U.S. Pat. No. 2, 003,123; U.S. Pat. No. 3,139,119; U.S. Pat. No. 3,143,150; U.S. Pat. No. 3,545,705; U.S. Pat. No. 3,632,068). After forming screens which were made with synthetic fiber threads were introduced, the use of flattened longitudinal threads was proposed for this type of screen also (U.S. Pat. No. 4,143,557). In recent years there have been proposals which suggest using flattened longitudinal threads with multi-layer, especially two- and three- layer forming screens (GB-A-2 157 328; U.S. Pat. No. 4,815, 499). In accordance with the statements made in these patents, the inventors expected a number of advantages.

If these concepts refer to metal screens, they cannot easily be transferred to plastic screens since the behavior of metal wires in a material compound is very different from that of synthetic threads. The same applies to the difference between one- and multi-layer materials. In general it can be said that the use of flattened longitudinal threads only has little or no influence on the important characteristics of a forming screen. Since the longitudinal threads, even in multi-layer forming screens, are stretched due to the thermo fastening process which is carried out in synthetic screens, as a rule, and consequently only show little distinctive crimpings and mainly run on the inside of the screen, the higher elasticity of the flattened longitudinal threads has few advantages due to the low height - which in any event is only achieved when the cross sectional area remains the same or is lower compared to the round threads.

SUMMARY OF THE INVENTION

The invention is directed to designing a forming screen of the above described kind so that considerably improved conditions with regard to the formation of paper and the abrasion characteristics are achieved.

This task is solved in accordance with the invention by a forming screen which has the following characteristics:

(a) at least part of the cross threads have a flattened cross section;

(b) the flattened cross threads are arranged in a manner which ensures that their cross sectional extension in the material plane is greater than lateral to the material plane; and (c) the ratio between the cross-sectional extension in the material plane to the cross-sectional extension lateral to the material plane ranges from 1.2 and 2.5, preferably 1.2 and 1.8.

DESCRIPTION OF THE DRAWINGS

The invention is explained in more detail with the help of the models shown in the drawing.

FIG. (1) shows a longitudinal section of a one-and-a-half layer forming screen;

Figure 1:
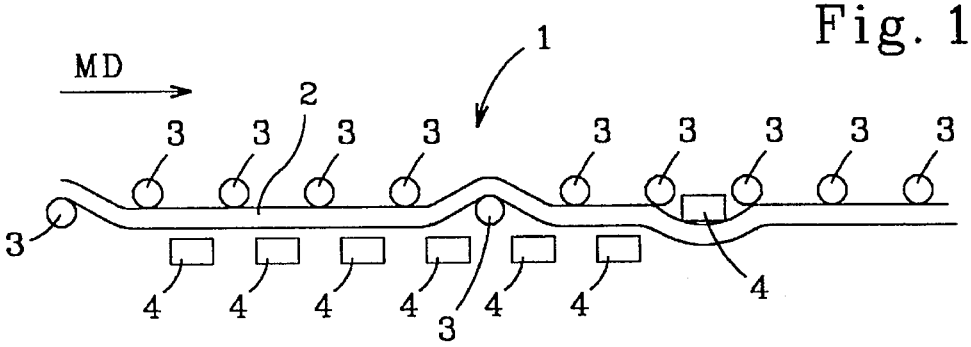
Figure 2:
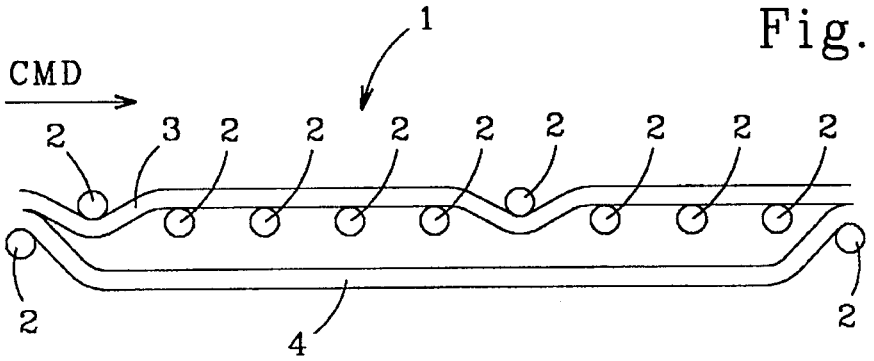
Figure 3:
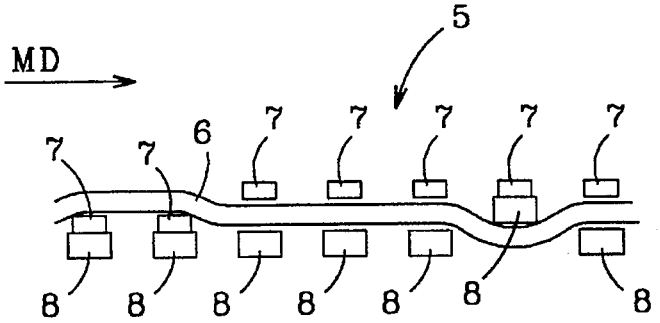
Figure 4:
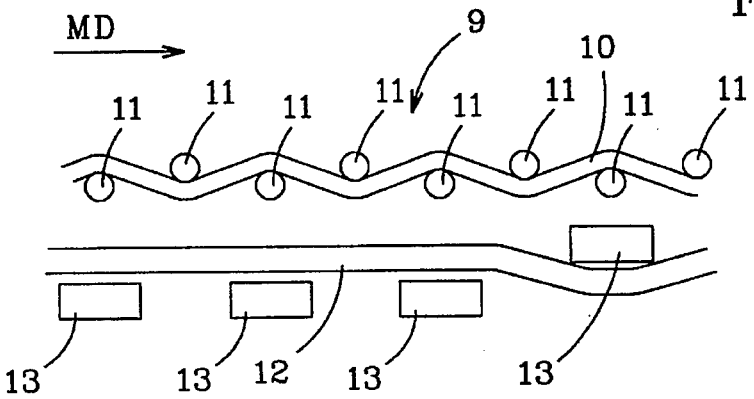
Figure 5:
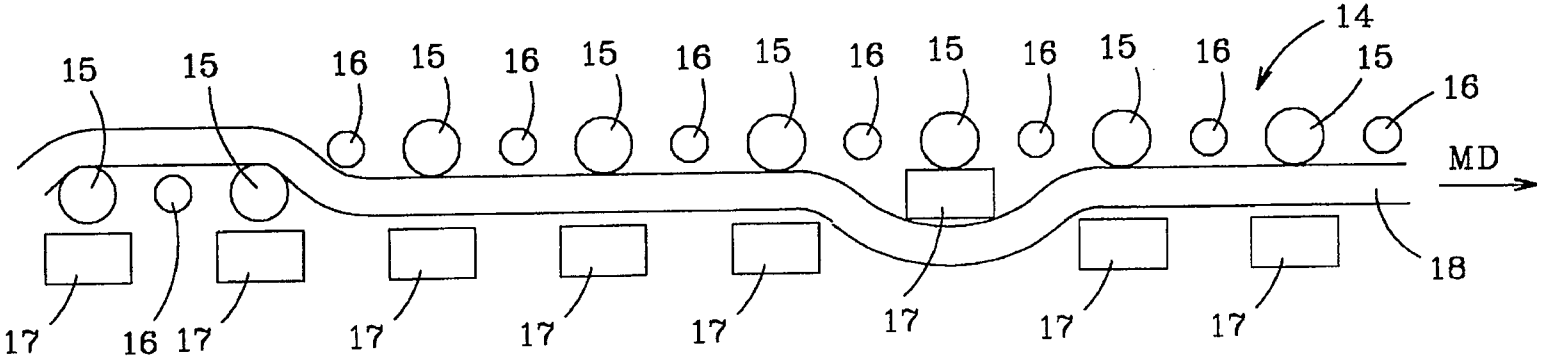
Figure 6:
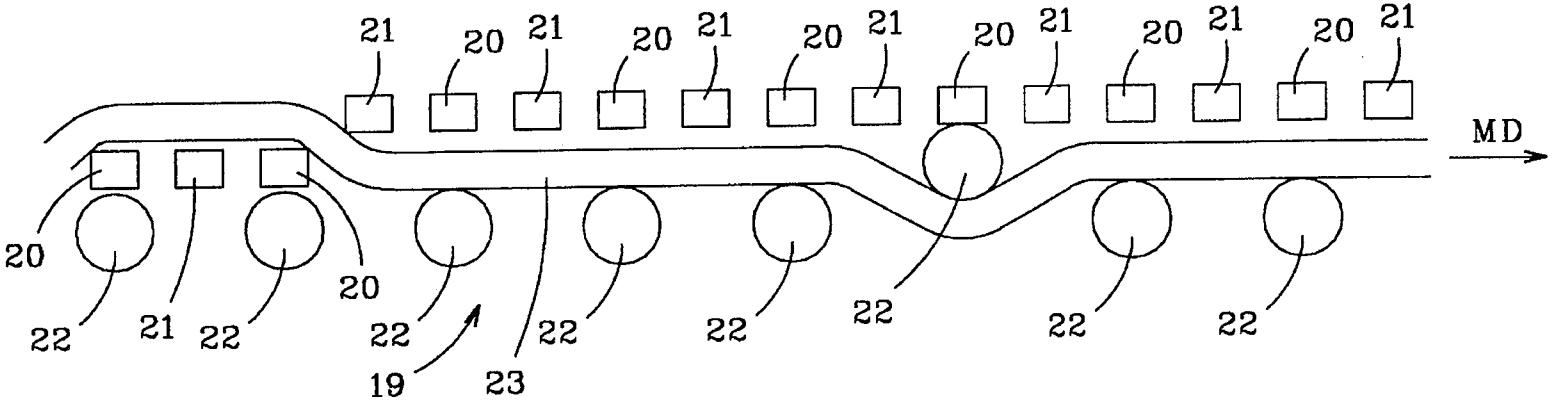
Figure 7:
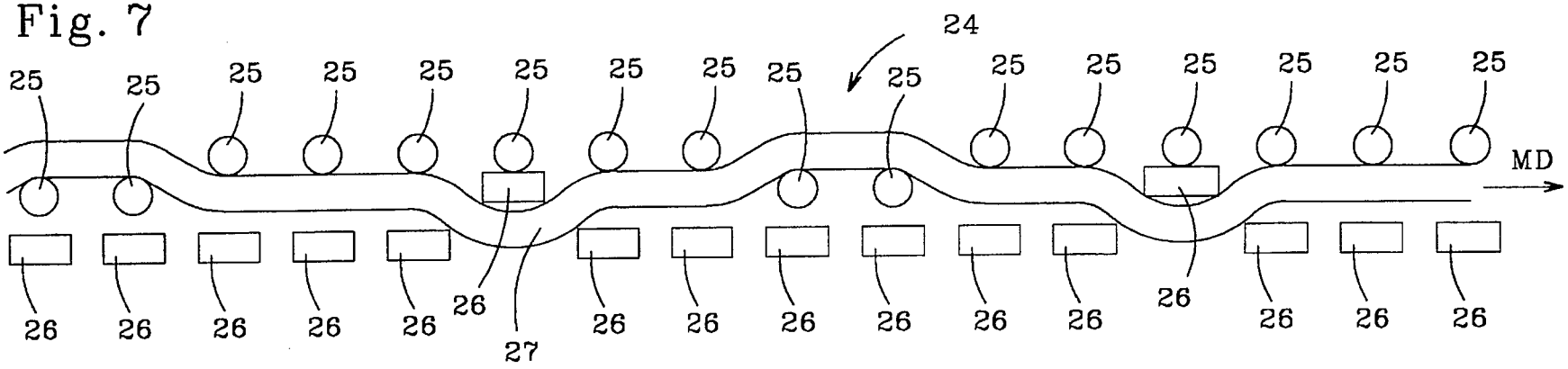
Figure 8:
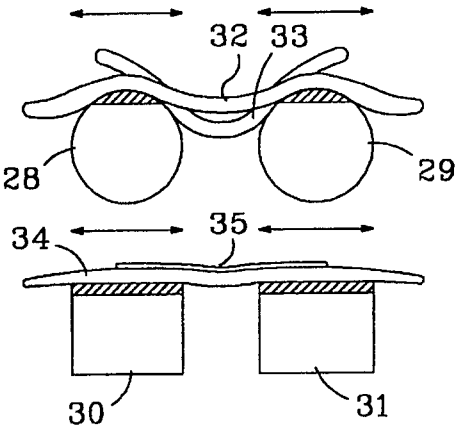

FIG. (2) shows a cross section of the forming screen in accordance with FIG. (1);

FIG. (3) shows a longitudinal section of a two-layer forming screen;

FIG. (4) shows a longitudinal section of a three-layer forming screen;

FIG. (5) shows a longitudinal section of a two-layer forming screen with padded cross threads;

FIG. (6) shows a longitudinal section of a different two-layer forming screen with padded cross threads;

FIG. (7) shows a longitudinal section of a different two-layer forming screen;

FIG. (8) shows the support of paper fibers with circular and with rectangular, flattened cross threads.

DETAILED DESCRIPTION OF THE INVENTION

The invention is based on the realization that by using flattened cross threads, one can exert considerably more and considerably diversified influence on the characteristics of a forming screen. This is based on the idea, which already is part of the invention, that the cross threads have much more distinctive crimpings after the thermo fixing process than the longitudinal threads. Provided that the cross sectional areas are equal, the flattened cross threads are considerably more flexible and therefore adjust better to the gradients of the longitudinal threads in the crimpings. This makes it possible to optimize the thickness of a forming screen with regard to the partially contradictory requirements of good draining characteristics, the availability of large abrasion volumes and the size of the free inside volume and to adjust them to the respective requirements of the respective paper machine. This means that it is possible to adjust a forming screen to a certain paper machine. This kind of adjustment was not possible with forming screens which consist of round threads and only insignificantly possible with forming screens which consist of flattened longitudinal threads. Apparently these possibilities have not been recognized for decades since the industry continued to believe that, as far as the use of flattened threads in forming screens was concerned, only a longitudinal arrangement of such threads would make sense.

It is especially preferable if a part or all of the cross threads of the first group, which are located in the plane of the paper side, are flattened. Since these flattened cross threads on the paper side extend laterally to the main direction of the fibers of the paper pulp material, a perfect fiber support is provided, and the danger that a part of the fibers slide into the inside of the screen is considerably reduced. The flattened cross threads function as small, transverse plateaus which effectively carry along the ascending paper pulp fibers and support them effectively since they run in the direction of the machine and prevent them from sliding off. The effect of interlacing which occurs with round threads is avoided for the most part, which means that it is considerably easier to remove the sheet of paper at the end of the sheet forming zone.

The basic idea of the invention can be put into practice with forming screens in which the first group of cross threads consists of at least two sub-groups of cross threads of which a first sub-group forms regular cross threads and a second sub-group forms padded cross threads. The padded cross threads can have floats which extend across more longitudinal threads than the longest floats of the regular cross threads which means that the transverse plateau effect, which is described above, is especially pronounced. It is possible, of course, to give the regular cross threads and the padded cross threads different cross-sectional areas and/or cross-sectional shapes.

The effect described above is especially effective when the cross threads float across a number of longitudinal threads which is larger than the number of cross threads across which the longitudinal threads float. This produces a distinct cross texture with a number of transverse plateaus which provide perfect support for the accumulated fibers especially due to their orientation, namely in the direction of the machine.

The floats of the flattened cross threads can be adjusted to the respective requirements. With a one-and-a-half layer material the longest floats should extend over at least four longitudinal threads, with a double layer material over at least three longitudinal threads and with a three-layer material over at least one longitudinal thread.

In accordance with another characteristic of the invention, the flattened cross threads of the first group have a fiber support width which is at least 9% larger than that of a circular thread with the same cross-sectional area. It is preferable that the fiber support width is at least 15%, and especially preferable that it is at least 30%. The fiber support width is the width of a plane thread surface which is produced when 10% of the height of the respective cross thread, i.e. the extension lateral to the material plane are removed starting from the paper side.

In accordance with another characteristic of the invention the degree of overlapping of the cross threads of the first group is at least 32%, preferably 37% and more preferably at least 42 or even 47%, and preferably at least 52% with one-and-a-half and two layer materials without padded cross threads. The degree of overlapping is defined as the product of the above defined fiber support width (in cm), the number of threads (thread density) per screen length and the FIG. 100. The degree of overlapping may be calculated as follows, Degree of overlapping fiber support width× thread density×100 If different types of thread are used for the first group of cross threads, degrees of overlapping must be determined for every type of thread. The overall degree of overlapping corresponds to the sum of the degrees of overlapping of the individual types of cross threads. With two-layer materials with padded cross threads or at least three-layer materials the degree of overlapping should at least be 40%, better yet 50 or even 55% and preferably 60%.

Using the basic principle of the presented invention, other advantages can be achieved if a part or all of the cross threads of the second group, which form the plane of the machine side, are flattened.

Such a concept has the advantage that the most important characteristics of the forming screen do not change as drastically and in general in a more equal manner than with forming screens in which these cross threads are formed by round threads. On one hand this is due to the fact that the supporting surface of the forming screen does not change as much or— with rectangular cross threads— practically does not change at all during abrasion, and that the cross threads adapt better to the lower side of the forming screen due to their increased flexibility, which means they do not project as much. The latter means that even the length of the abrasion area only changes insignificantly in the course of time. This means that there are new possibilities to optimize the screen. It is possible to have a considerably higher abrasion volume while maintaining the thickness of the forming screen. On the other hand it is possible to reduce the thickness of the forming screen while maintaining a constant abrasion volume. It is especially because the cross threads of the second group project from the machine side that it is possible to strongly influence the abrasion volume on one hand and the thickness of the screen on the other hand with the help of these cross threads.

With a one and a half-layer material the cross threads of the second group should float across at least four longitudinal threads and with a two-layer material across at least five longitudinal threads. It is possible to differentiate according to the shank number of the cross threads with a two-layer material. With a shank number of fourteen the cross threads of the second group should float across at least ten longitudinal threads and with a shank number of sixteen they should float across at least twelve longitudinal threads.

The ratio of the maximum to the standard abrasion area should be a maximum of 2.9, preferably 2.2 and more preferably 1.7, and no more than 1.4 with the flattened cross threads of the second group. The abrasion area of a machine side floating thread is its machine side contact surface with the elements of the paper machine. The maximum abrasion area is the largest contact surface which occurs in the course of the wear of the cross threads. The standard abrasion surface is the contact surface which is produced after 10% of the height of the respective cross thread, i.e. the extension of the corresponding thread transverse to the material plane are removed.

As far as the degree of overlapping is concerned, it should exceed 52%, better yet 62% with cross threads of the second group if it is a one-and-a-half layer material. With a two-layer material without padded cross threads in the first group the degree of overlapping of the cross threads of the second group should exceed 40%, better yet 45%, with a two-layer material with padded cross threads in the first group it should exceed 32%, preferably 37%. With a three-layer material in which the ratio of the number of cross threads of the first group to the number of the cross threads of the second group is 1:1, the degree of overlapping should exceed 45%, better yet 50%. With a three-layer material in which the ratio of the number of cross threads of the first group to the number of cross threads of the second group is 3:2, the degree of overlapping should exceed 42%, better yet 46%. With a three-layer material in which the ratio of the number of cross threads of the first group to the number of cross threads of the second group is 2:1, the degree of overlapping should be at least 39%, better yet 42%.

It is further possible to combine the flattened cross threads in accordance with the invention with such longitudinal threads. The flattened longitudinal threads should be arranged in a manner which ensures that their cross-sectional dimension in the material plane is larger than that transverse to the material plane and the ratio between cross-sectional dimension in the material plane to the cross-sectional dimension transverse to the plane of the material ranges from 1.2 and 2.2. The flattened longitudinal threads should have an area of 0,015 to 0.226 $mm^2$.

It is advantageous for the flattened cross threads of the first group to have an area of 0.013 to 0.195 $mm^2$, and those of the second group to have an area of 0.022 to 0.4 $mm^2$.

The flattened threads can have any cross-sectional shape as long as the conditions of the basic ideas of the invention are adhered to. Especially suitable as flattened threads are threads of oval, cross section especially elliptic and above all rectangular cross sections, the latter preferably with aligned edges. It is possible to use other shapes of thread, for example trapezoidal or rhomboidal shapes.

The forming screen in accordance with the invention can be adjusted within very wide limits with regard to its open inside volume. The three dimensional inside volume of the fabric which is not occupied by threads. The inside volume may be calculated pursuant to the following equation:

$$\text{Inside Volume} = \left[ 1 - \left( \frac{W}{t \times p \times 1000} \right) \right] \times 100\%,$$

where W= the weight of the fabric per unit area ($g/m^2$), t= fabric thickness (mm), ρ= density of the polymer, which is 1.39 g/cc for polyester fabric and 1.37 g/cc for polyester/polyamide fabric. This makes it possible to achieve a perfect compromise between the draining performance on one hand and the so-called water carrying on the other hand. The value of less than 54 $mm^3/cm^2$, preferably less than 46 $mm^3/cm^2$ should not be exceeded. However, it is possible to differentiate in accordance with the following with regard to the structure of the material.

with a one-and-a-half material less than 54 $mm^3/cm^2$, preferably less than 46 $mm^3/cm^2$;

with a two-layer material less than 38 $mm^3/cm^2$, preferably less than 33 $mm^3/cm^2$;

with a two-layer material with a first group of cross threads of normal cross threads and padded or stuffer cross threads less than 53 $mm^3/cm^2$; preferably less than 44 $mm^3/cm^2$;

with a three-layer material with a ratio of the thread number of the first group of cross threads to the second group of cross threads of 2:1 less than 60 $mm^3/cm^2$; preferably less than 55 $mm^3/cm^2$;

with a three-layer material with a ratio of the thread number of the first to the second group of cross threads of 1:1 less than 40 $mm^3/cm^2$, preferably less than 38 $mm^3/cm^2$.

The unit of the area which is called "$cm^2$" extends in the material plane.

If the material has at least three layers and the layers are connected with binding threads, it is advisable to also use binding threads with a flattened cross section and a cross-sectional extension of the material plane which is larger than the transverse one. The cross-sectional area should range from 0.013 to 0,069 $mm^2$.

The cross section of the one-and-a-half layer forming screen shown in FIGS (1) and (2) shows circular longitudinal threads (2) which run in machine direction (MD). The forming screen (1) also has a first group of cross threads (3), whose cross section also shows a circular cross section. Among them is a second group of cross threads (4) which display a rectangular cross section whereby the extension transverse to the plane of the forming screen (1) is smaller than the one in its plane.

The integration of the longitudinal threads (2) and the first group of cross threads (3) is such that the result is a monoplane surface, i.e. paper side. One longitudinal thread (2) binds every fifth cross thread (3) of the first group. The cross threads (3) of the first group float across four longitudinal threads before they bind with a longitudinal thread (2) (cf FIG. (2)). This results in a distinct transverse structure on the paper side of the forming screen (1), i.e. the cross floats of the cross threads (3) of the first group dominate the paper side.

The second group of cross threads (4) floats towards the machine side across a total of nine longitudinal threads (2) before these cross threads (4) bind with a longitudinal thread (2). Since the cross threads (4) are much more flexible than other round cross threads with the same cross sectional area, they are not bow-shaped. Due to their elasticity they run straight instead between the bindings of the longitudinal threads. This characteristic, and the fact that the rectangular cross section result in the abrasion area, i.e. the area upon which the forming screen (1) fritionally slides over the fixed parts of the paper machine, hardly changes with increasing wear. The change of the screen thickness per time unit is smaller compared to that which occurs when cross threads with a circular cross section are used and remains constant for the most part. This means that the screening characteristics only change little during the operation of the forming screen (1) and if they change, they only change very evenly.

The example of a two-layer forming screen (5) shown in FIG. (3) has round longitudinal threads (6) as well as a first group of cross threads (7) on the paper side and a second group of cross threads (8) on the machine side. One cross thread each (7) of the first group is located above one cross thread (8) of the second group. Contrary to the example according to FIGS. (1) and (2), the cross threads (7, 8) of both groups have a rectangular, flattened cross section. The longitudinal threads (6) initially float across two cross threads (7) of the first group on the paper side and then between three cross threads (7, 8) of the first and the second group and then bind with a cross thread (8) of the second group.

Due to their flattened cross section the cross threads (7) of the first group form a transverse plateau which supports the paper pulp fibers which mainly run in the direction of the forming screen (5). The cross threads (7) of the first group are not as high as the circular cross threads with the same cross sectional area which means that the results are flatter crimpings for the longitudinal threads (6). This reduces the problem of screen markings and ensures a better length consistency of the forming screen (5) on the paper side.

The same applies to the cross threads (8) of the second group. Their abrasion characteristics correspond to the cross threads (4) in the example in accordance with FIGS. (1) and (2).

FIG. (4) shows a forming screen (9) which consists of three layers. It has paper-side longitudinal threads (10) which bind into plain weave with a first group of cross threads (11). The longitudinal threads (10) as well as the cross threads (11) have a circular cross section. Machine-side longitudinal threads (12), which also have a round cross section, run below the paper-side longitudinal threads (10). They bind with a second group of cross threads (13) which run along the machine side and protect the longitudinal threads (10, 12) against wear. The cross threads of the second group (13) have a rectangular cross section. Their cross sectional area is larger than that of the cross threads (11) of the first group. The ratio of the number of cross threads (11) of the first group to that of the cross threads (13) of the second group is 2:1. Within the framework of the invention it is possible to also use flattened, especially rectangular cross sections for the cross threads (11) of the first group. The use of flattened cross sectional shapes reduces the thickness of the forming screen (9) compared to the models with round cross sections and the same cross sectional area.

FIG. (5) shows a two-layer forming screen (14) which has a first group of cross threads in the upper layer whereby normal cross threads (15) alternate with filling cross threads (16) in this group. They all have a circular cross section. The lower, machine-side layer is made up of a second group of longitudinally floating yarns (17) with a rectangular cross section. Both groups of cross threads (15, 16, 17) are bound by longitudinal threads (18) which each float across two normal cross threads (15) and a filling cross thread (16) on the paper side and each bind a cross thread (17) of the second group on the machine side. Adjacent longitudinal threads (18) are off-set by three cross threads (15, 16) of the first group in machine direction.

The structure of the forming screen (19) shown in FIG. (6) is similar to that of the forming screen (14) in accordance with FIG. (5). Accordingly, it has two layers and alternately normal cross threads (20) and stuffer yarn (21) which form the first group of cross threads running along the paper side. Both have a flattened, rectangular cross section.

The lower layer is made up of a second group of cross threads (22) which, in this instance, have a circular cross section and are bound floating longitudinally on the machine side. The longitudinal threads (23) float in the same manner as described in the example in accordance with FIG. (5).

While in the example in accordance with FIG. (4) the emphasis was placed on a constant and evenly changing abrasion characteristics by using rectangular cross threads (17) of the second group, the rectangular cross sections of the normal and stuffer cross threads (20, 21) in the example in accordance with FIG. (6) ensure an improved fiber support, especially when these cross threads (20, 21) dominate on the paper side and produce a transversal structure. The skilled in the art recognize that stuffer yarns differ from standard cross threads because their diameter is somewhat smaller, and because they may be made from other materials. Depending on the requirements of the corresponding paper machine, it is possible to optimize the design. The flattened cross sections have one optional parameter more than round cross sections, a fact which increases the design possibilities while taking the many requirements into consideration which the forming screen has to meet.

The example shown in FIG. (7) also is a two-layer forming screen (24), however without any padded cross threads. A first group of cross threads (25) with a round cross section makes up the upper layer. The lower layer consists of a second group of cross threads (26) which have a rectangular cross section and are bound floating longitudinally. The longitudinal threads (27) which run in machine direction which float across two cross threads (25) each of the first group on the paper side and bind one cross thread (26) each of the second group on the paper side. Adjacent longitudinal threads (27) are off-set by three cross threads (25) each of the first group in machine direction. By using cross threads (26) of the second group with a rectangular cross section, the thickness of the screen is considerably smaller compared to a forming screen in which the cross threads of the second group have the same cross sectional area but a round cross section.

FIG. (8) shows a cross-sectional view of two adjacent cross threads (28, 29) with a round cross section and underneath two adjacent cross threads (30, 31) with a rectangular cross section. The round cross threads (28, 29) and the rectangular cross threads (30, 31) have the same horizontal measurements and corresponding cross sectional areas. The minimum distance between the round cross threads (28, 29) corresponds to that between the rectangular cross threads (3o, 31).

The round cross sections (28, 29) support the paper pulp fibers (32, 33). Due to the difference in speed between the fibrous material and the paper machine screen they run in machine direction. The support is insufficient, since there is a tendency to pull the paper pulp fibers (32, 33) into the split which opens up conically to the top between the round cross threads (28, 29) due to the draining stream and also the negative pressure. This causes problems for the draining process, and later on it is difficult to remove the sheet because of the interlocking effect.

There are also paper pulp fibers (34, 35) in the rectangular cross threads (30, 31). Although the split between the rectangular cross threads (30, 31) is as large as the one between the round cross threads (28, 29), it becomes obvious that the support of the paper pulp fibers (34, 35) is improved considerably. The paper pulp fibers (34, 35) are no longer pulled into the split between the cross threads (30, 31) and thus do not interfere with the draining process. There is no interlocking effect with the cross threads (30, 31) which could make the removal of the sheet more difficult.

With the help of FIG. (8).it is possible to explain the definition of the fiber support width (FIBER SUPPORT WIDTH). The fiber support width is the result of the removal of 10% of the height of the upper side of the threads. With the rectangular cross threads (30, 31) the fiber support width consequently corresponds to the width of these cross threads (30, 31). With the round cross threads (28, 29) the fiber support width - indicated by the length of the arrows - is considerably smaller than the diameter of the cross threads (28, 29) and therefore smaller than the fiber support width of the rectangular cross threads (30, 31).

We claim:

1. A multi-layer paper machine forming screen having a paper side and a machine side, comprising:

a) a plurality of synthetic longitudinally extending machine direction threads;

b) a plurality of synthetic cross threads extending generally transverse to said machine direction threads, said cross threads disposed in first and second groups and at least some of said cross threads have a flattened cross section;

c) said first group threads are disposed in a plane on the paper side and have a repeat floating over the machine direction threads by at least the number of machine direction threads floating over the cross threads on the paper side;

d) said second group threads form a plane on the machine side; and e) the flattened cross threads extend parallel to the paper side plane a distance from about 1.2 to about 2.2 times the distance by which the flattened cross threads extend transverse to the paper side plane.

2. The screen of claim 1, wherein:

a) the flattened cross threads form at least a portion of said first group.

3. The screen of claim 2, wherein:

a) all threads in said first group are flattened.

4. The screen of claim 2, wherein:

a) the cross threads of said first group are disposed in first and second subgroups, and the threads of said second subgroup are filling threads.

5. The screen of claim 4, wherein:

a) said filling threads have a repeat floating over a greater number of machine direction threads than the number of machine direction threads over which the threads of said first subgroup float.

6. The screen of claim 4, wherein:

a) the threads of said first and second subgroups have deviating cross sectional areas and/or cross sectional shapes.

7. The screen of claim 1, wherein:

a) said first group threads have a repeat floating across a number of machine direction threads which exceeds the number of cross threads over which the machine direction threads float.

8. The screen of claim 2, wherein:

a) the screen is formed in a one-and-a-half layer material, and threads of said first group have a repeat floating over at least four machine direction threads.

9. The screen of claim 2, wherein:

a) the screen is formed in a double layer material, and the threads of said first group have a repeat floating over at least three machine direction threads.

10. The screen of claim 2, wherein:

a) the screen is formed in a triple layer material, and the threads of said first group have a repeat floating over at least one machine direction thread.

11. The screen of claim 2, wherein:

a) the flattened cross threads have a fiber support width which exceeds by at least 9% the fiber support width of a circular thread.

12. The screen of claim 2, wherein:

a) the threads of said first group overlap at least 32% when the screen is formed from one of one-and-a-half and two-layer materials.

13. The screen of claim 2, wherein:

a) the threads of said first group overlap at least 40% when the screen comprises one of two-layer material having filling threads and three-layer material.

14. The screen of claim 1, wherein:

a) at least some of the cross threads of said second group are flattened.

15. The screen of claim 14, wherein:

a) all cross threads of said second group are flattened.

16. The screen of claim 14, wherein:

a) the screen is a one-and-a-half material, and the cross threads of said second group have a repeat floating over at least four machine direction threads.

17. The screen of claim 14, wherein:

a) the screen is a two-layer material, and the cross threads of said second group have a repeat floating over at least five machine direction threads.

18. The screen of claim 14, wherein:

a) the screen is a three-layer material, and the cross threads of said second group have a repeat floating over one fewer machine direction threads than the shaft number of the cross threads of said second group.

19. The screen of claim 14, wherein:

a) the ratio of the maximum abrasion area to the standard abrasion area is no more than 2.9 when the second group includes flattened cross threads.

20. The screen of claim 14, wherein:

a) the screen is a one-and-a-half layer material, and has a degree of overlapping of the cross threads of said second group exceeding 52%.

21. The screen of claim 14, wherein:

a) the screen is a two-layer material, and the degree of overlapping of the cross threads of said second group exceeds 40% when the first group includes no filling threads and exceeds 32% when the first group includes filling threads.

22. The screen of claim 14, wherein:

a) the screen is a three-layer material, and the degree of overlap exceeds 45% when the ratio of the number of cross threads of the first group to the number of cross threads of the second group is 1:1, exceeds 42% when the ratio of the number of cross threads of the first group to the number of cross threads of the second group is 3:2, and exceeds 39% when the ratio of the number of cross threads of the first group to the number of cross threads of the second group is 2:1.

23. The screen of claim 20, wherein:

a) at least some of the machine direction threads are flattened, the flattened machine direction threads extend a distance parallel to a plane of the paper side from about 1.2 to about 2.2 times the distance by which the flattened machine direction threads extend transverse to the plane of the paper side.

24. The screen of claim 23, wherein:

a) all machine direction threads are flattened.

25. The screen of claim 24, wherein:

a) the cross sectional area of the machine direction threads is from about 0.15 to about 0.226 $mm^2$.

26. The screen of claim 2, wherein:

a) the cross sectional area of the cross threads of said first group is from about 0.013 to about 0.195 $mm^2$.

27. The screen of claim 14, wherein:

a) the cross sectional area of the flattened cross threads of said second group is from about 0.022 to about 0.4 $mm^2$.

28. The screen of claim 1, wherein:

a) the flattened threads have a configuration selected from the group consisting of oval and rectangular cross section.

29. The screen of claim 1, wherein:

a) the screen has an inside open volume of less than 54 $mm^3/cm^2$.

30. The screen of claim 29, wherein:

a) the inside open volume is less than 55 $mm^3/cm^2$ where the screen is a one-and-a-half layer material.

31. The screen of claim 29, wherein:

a) the inside open volume is less than 38 $mm^3/cm^2$ where the screen is a two-layer material.

32. The screen of claim 29, wherein:

a) the inside open volume is less than 53 $mm^3/cm^2$ where the screen is a two-layer material and the first group includes filling threads.

33. The screen of claim 29, wherein:

a) the inside open volume is less than 60 $mm^3/cm^2$ and the ratio of the thread count of the first to the second group is 2:1 where the screen is a three-layer material.

34. The screen of claim 29, wherein:

a) the inside open volume is less than 40 $mm^3/cm^2$ and the ratio of the thread count of the first group to the second group is 1:1 where the screen is a three-layer material.

35. The screen of claim 1, wherein:

a) the screen consists of at least three layers, and the layers are interconnected through binding threads having a flattened cross section.

36. The screen of claim 35, wherein:

a) the cross sectional area of the binding threads is from about 0.12 to about 0.062 $mm^2$.

* * * * *